US009584900B2

(12) United States Patent
Hsiao

(10) Patent No.: US 9,584,900 B2
(45) Date of Patent: Feb. 28, 2017

(54) CUSTOMIZATION EARPHONE STRUCTURE AND DETACHABLE AUDIO BROADCASTING MODULE THEREOF

(71) Applicant: COOLER MASTER TECHNOLOGY INC., New Taipei (TW)

(72) Inventor: Shih-Hsiung Hsiao, New Taipei (TW)

(73) Assignee: COOLER MASTER TECHNOLOGY INC., New Taipei (TW)

( * ) Notice: Subject to any disclaimer, the term of this patent is extended or adjusted under 35 U.S.C. 154(b) by 97 days.

(21) Appl. No.: 14/796,473

(22) Filed: Jul. 10, 2015

(65) Prior Publication Data

US 2016/0330542 A1 Nov. 10, 2016

(30) Foreign Application Priority Data

May 5, 2015 (CN) ..... 2015 1 0223441

(51) Int. Cl.

| | |
|---|---|
| ***H04R 1/10*** | (2006.01) |
| ***H04R 1/28*** | (2006.01) |
| ***H04R 1/26*** | (2006.01) |
| ***H04R 1/02*** | (2006.01) |
| ***H04H 40/45*** | (2008.01) |

(52) U.S. Cl.

CPC ..... *H04R 1/2807* (2013.01); *H04H 40/45* (2013.01); *H04R 1/028* (2013.01); *H04R 1/1091* (2013.01); *H04R 1/26* (2013.01); *H04R 1/2803* (2013.01); *H04R 2499/11* (2013.01)

(58) Field of Classification Search

CPC .... H04R 1/2807; H04R 1/028; H04R 1/1091; H04R 1/26; H04R 1/2802; H04R 2499/11; H04H 40/45

See application file for complete search history.

(56) References Cited

U.S. PATENT DOCUMENTS

| | | | | |
|---|---|---|---|---|
| 9,319,771 | B2 * | 4/2016 | Yuen | H04R 1/1058 |
| 2013/0177195 | A1 * | 7/2013 | Sze | H04R 1/1033 381/384 |
| 2014/0036127 | A1 * | 2/2014 | Pong | H04R 1/028 348/333.01 |
| 2016/0212521 | A1 * | 7/2016 | Huang | H04R 1/1008 |
| 2016/0353191 | A1 * | 12/2016 | Oishi | H04R 1/1075 |

* cited by examiner

*Primary Examiner* — Regina N Holder

(74) *Attorney, Agent, or Firm* — Li & Cai Intellectual Property (USA) Office

(57) ABSTRACT

A customization earphone structure and a detachable audio broadcasting module thereof are disclosed in the instant disclosure. The detachable audio broadcasting module includes an amplifier assembly and a detachable sound guiding assembly. The amplifier assembly includes a first outer casing and a plurality of first retaining structures disposed on the first outer casing. The first outer casing has an assembly concave groove. The detachable sound guiding assembly includes a second outer casing corresponding to the assembly concave groove, a sound-guiding component fixed and enclosed inside the second outer casing, and a plurality of second retaining structures disposed on the second outer casing. The detachable sound guiding assembly is received inside the assembly concave groove, the second outer casing is detachably positioned inside the assembly concave groove by respectively matching the second retaining structures and the first retaining structures with each other.

11 Claims, 5 Drawing Sheets

CUSTOMIZATION EARPHONE STRUCTURE AND DETACHABLE AUDIO BROADCASTING MODULE THEREOF

BACKGROUND OF THE INVENTION

1. Field of the Invention

The instant disclosure relates to an earphone structure and an audio broadcasting module thereof, and more particularly to a customization earphone structure and a detachable audio broadcasting module thereof.

2. Description of Related Art

Along with continuous development of technology, electronic products are developed towards a trend of lightweight and miniaturization, and people can use the miniaturized electronic products such as radio, MP3 player, smart phone, etc., at anywhere anytime. Regardless of the type of the aforementioned electronic product, to facilitate the user hearing sound information provided by the electronic product without interrupting others, earphone becomes an indispensable accessory of the electronic product. Moreover, the earphone also provides a better sound transmission to a listener, and the listener can clearly hear and understand the sound content, which is superior to a situation that the sound is transmitted in the air causing the sound indistinct. Especially, when the user is in a moving state, for example, in sport, driving, intense activity or a noisy environment, the user can still hear the sound clearly by using the earphone.

SUMMARY OF THE INVENTION

One aspect of the instant disclosure relates to a customization earphone structure and a detachable audio broadcasting module thereof.

One of the embodiments of the instant disclosure provides a detachable audio broadcasting module, comprising: an amplifier assembly and a plurality of detachable sound guiding assemblies. The amplifier assembly includes a first outer casing, a plurality of first retaining structures disposed on the first outer casing, and a first conductive matching structure disposed on an inner surface of the first outer casing, wherein the first outer casing has an amplifier chamber with a predetermined space formed therein, and the first outer casing has an assembly concave groove communicated with the amplifier chamber. Each detachable sound guiding assembly includes a second outer casing corresponding to the assembly concave groove, a coaxial dual-frequency sound-guiding component fixed and enclosed inside the second outer casing, a plurality of second retaining structures disposed on the second outer casing and respectively corresponding the first retaining structures, and a second conductive matching structure disposed on an outer surface of the second outer casing and corresponding to the first conductive matching structure, wherein the coaxial dual-frequency sound-guiding component includes a woofer vibrating membrane assembly, a tweeter vibrating membrane assembly, and a common magnetic loop assembly disposed between the woofer vibrating membrane assembly and the tweeter vibrating membrane assembly and provided for the woofer vibrating membrane assembly and the tweeter vibrating membrane assembly, and the second outer casing has a sound output opening More particularly, one of the detachable sound guiding assemblies is received inside the assembly concave groove of the amplifier assembly, the second outer casing of the detachable sound guiding assembly is detachably positioned inside the assembly concave groove of the amplifier assembly by respectively matching the second retaining structures and the first retaining structures with each other, and the second conductive matching structure electrically contacts the first conductive matching structure.

Another one of the embodiments of the instant disclosure provides a detachable audio broadcasting module, comprising: an amplifier assembly and a detachable sound guiding assembly. The amplifier assembly includes a first outer casing and a plurality of first retaining structures disposed on the first outer casing, wherein the first outer casing has an amplifier chamber with a predetermined space formed therein, and the first outer casing has an assembly concave groove communicated with the amplifier chamber. The detachable sound guiding assembly includes a second outer casing corresponding to the assembly concave groove, a sound-guiding component fixed and enclosed inside the second outer casing, and a plurality of second retaining structures disposed on the second outer casing and respectively corresponding the first retaining structures. More particularly, the detachable sound guiding assembly is received inside the assembly concave groove of the amplifier assembly, and the second outer casing of the detachable sound guiding assembly is detachably positioned inside the assembly concave groove of the amplifier assembly by respectively matching the second retaining structures and the first retaining structures with each other.

More particularly, when the sound-guiding component is a single-frequency sound-guiding component, the single-frequency sound-guiding component includes a loudspeaker vibrating membrane assembly and a magnetic loop assembly adjacent to the loudspeaker vibrating membrane assembly and provided for the loudspeaker vibrating membrane assembly.

More particularly, when the sound-guiding component is a coaxial dual-frequency sound-guiding component, the coaxial dual-frequency sound-guiding component includes a woofer vibrating membrane assembly, a tweeter vibrating membrane assembly, and a common magnetic loop assembly disposed between the woofer vibrating membrane assembly and the tweeter vibrating membrane assembly and provided for the woofer vibrating membrane assembly and the tweeter vibrating membrane assembly, and the second outer casing has a sound output opening.

Yet another one of the embodiments of the instant disclosure provides a customization earphone structure, comprising: an earphone frame and two detachable audio broadcasting modules respectively disposed on two opposite end portions of the earphone frame. Each detachable audio broadcasting module includes an amplifier assembly and a detachable sound guiding assembly. The amplifier assembly includes a first outer casing, a plurality of first retaining structures disposed on the first outer casing, and a first conductive matching structure disposed on an inner surface of the first outer casing, wherein the first outer casing has an amplifier chamber with a predetermined space formed therein, and the first outer casing has an assembly concave groove communicated with the amplifier chamber. The detachable sound guiding assembly includes a second outer casing corresponding to the assembly concave groove, a coaxial dual-frequency sound-guiding component fixed and enclosed inside the second outer casing, a plurality of second retaining structures disposed on the second outer casing and respectively corresponding the first retaining structures, and a second conductive matching structure disposed on an outer surface of the second outer casing and corresponding to the first conductive matching structure, wherein the coaxial dual-frequency sound-guiding component includes a woofer vibrating membrane assembly, a tweeter vibrating membrane assembly, and a common magnetic loop assembly disposed between the woofer vibrating membrane assembly and the tweeter vibrating membrane assembly and provided for the woofer vibrating membrane assembly and the tweeter vibrating membrane assembly, and the second outer casing has a sound output opening. More particularly, the detachable sound guiding assembly is received inside the assembly concave groove of the amplifier assembly, the second outer casing of the detachable sound guiding assembly is detachably positioned inside the assembly concave groove of the amplifier assembly by respectively matching the second retaining structures and the first retaining structures with each other, and the second conductive matching structure electrically contacts the first conductive matching structure.

Therefore, because the designs of "the amplifier assembly includes a first outer casing, a plurality of first retaining structures disposed on the first outer casing, and a first conductive matching structure disposed on the first outer casing" and "the detachable sound guiding assembly includes a second outer casing corresponding to the assembly concave groove, a coaxial dual-frequency sound-guiding component fixed and enclosed inside the second outer casing, a plurality of second retaining structures disposed on the second outer casing and respectively corresponding the first retaining structures, and a second conductive matching structure disposed on an outer surface of the second outer casing and corresponding to the first conductive matching structure", when one of the detachable sound guiding assemblies is received inside the assembly concave groove of the amplifier assembly according to different requirements, the second outer casing of the detachable sound guiding assembly is detachably positioned inside the assembly concave groove of the amplifier assembly by respectively matching the second retaining structures and the first retaining structures with each other, and the second conductive matching structure electrically contacts the first conductive matching structure. Therefore, by using the detachable sound guiding assembly 2, the customization earphone structure Z and the detachable audio broadcasting module M thereof disclosed by the present invention may change or adjust the quality of the sound output according to different application requirements, thereby achieving the need of customization.

To further understand the techniques, means and effects of the instant disclosure applied for achieving the prescribed objectives, the following detailed descriptions and appended drawings are hereby referred to, such that, and through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

The embodiments of "a customization earphone structure and a detachable audio broadcasting module thereof" of the instant disclosure are described. Other advantages and objectives of the instant disclosure can be easily understood by one skilled in the art from the disclosure. The instant disclosure can be applied in different embodiments. Various modifications and variations can be made to various details in the description for different applications without departing from the scope of the instant disclosure. The drawings of the instant disclosure are provided only for simple illustrations, but are not drawn to scale and do not reflect the actual relative dimensions. The following embodiments are provided to describe in detail the concept of the instant disclosure, and are not intended to limit the scope thereof in any way.

Figure 1:
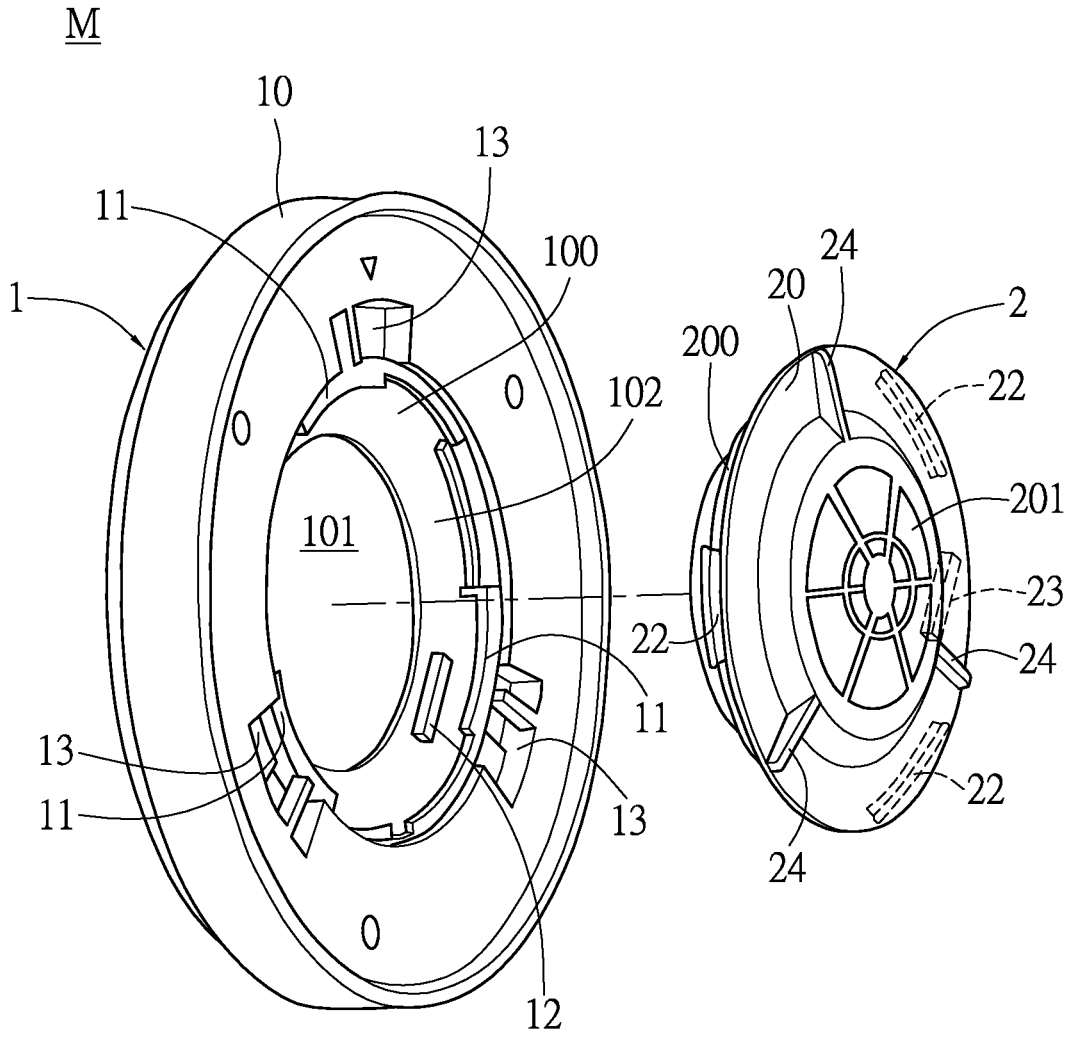
FIG. 1 shows a perspective, exploded, schematic view of the detachable audio broadcasting module according to the instant disclosure.
Figure 2:
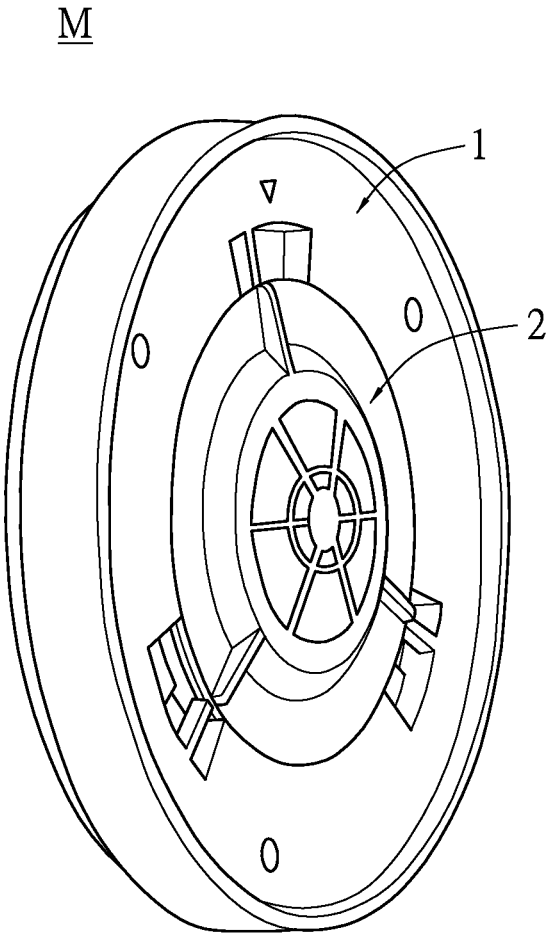
FIG. 2 shows a perspective, assembled, schematic view of the detachable audio broadcasting module according to the instant disclosure.
Figure 3:
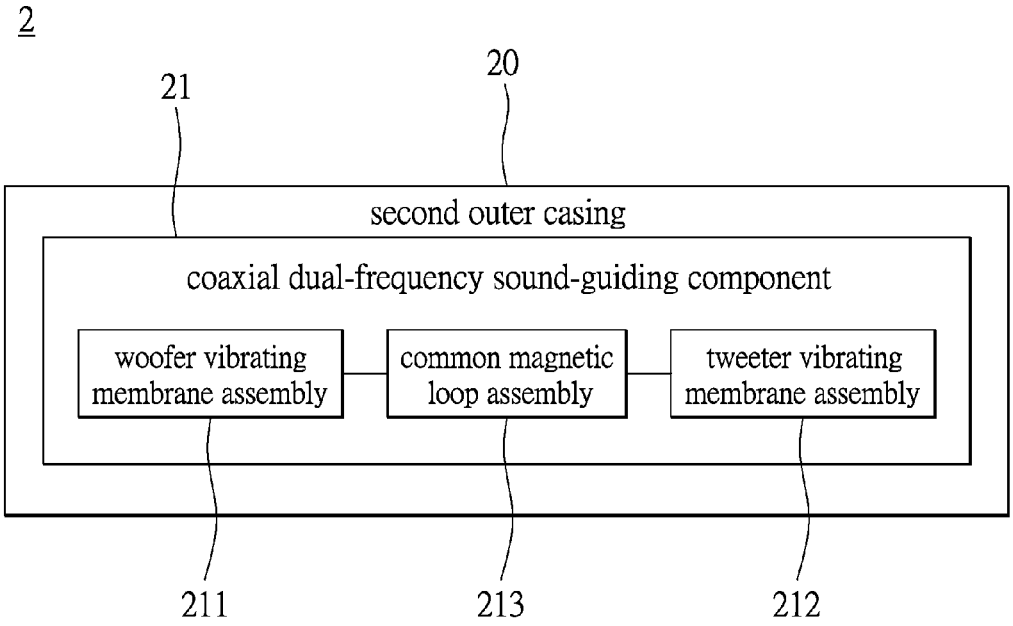
FIG. 3 shows a function block of the detachable sound guiding assembly of the detachable audio broadcasting module using a coaxial dual-frequency sound-guiding component according to the instant disclosure.

Referring to FIG. 1 to FIG. 3, the instant disclosure provides a detachable audio broadcasting module M, comprising: an amplifier assembly 1 and a plurality of detachable sound guiding assemblies 2, and both FIG. 1 and FIG. 2 showing only one of the detachable sound guiding assemblies 2 is an example in the instant disclosure.

First, as shown in FIG. 1, the amplifier assembly 1 includes a first outer casing 10, a plurality of first retaining structures 11 disposed on an inner surface 100 of the first outer casing 10, and a first conductive matching structure 12 disposed on the inner surface 100 of the first outer casing 10. More particularly, the first outer casing 10 has an amplifier chamber 101 with a predetermined space formed therein, and the first outer casing 10 has an assembly concave groove 102 communicated with the amplifier chamber 101.

Moreover, referring to FIG. 1 and FIG. 3, each detachable sound guiding assembly 2 includes a second outer casing 20 corresponding to the assembly concave groove 102, a coaxial dual-frequency sound-guiding component 21 fixed and enclosed inside the second outer casing 20, a plurality of second retaining structures 22 disposed on the second outer casing 20 and respectively corresponding the first retaining structures 11, and a second conductive matching structure 23 disposed on an outer surface 200 of the second outer casing 20 and corresponding to the first conductive matching structure 12. More particularly, the coaxial dual-frequency sound-guiding component 21 includes a woofer vibrating membrane assembly 211, a tweeter vibrating membrane assembly 212, and a common magnetic loop assembly 213 disposed between the woofer vibrating membrane assembly 211 and the tweeter vibrating membrane assembly 212 and provided for the woofer vibrating membrane assembly 211 and the tweeter vibrating membrane assembly 212 to use it, and the second outer casing 20 has a sound output opening 201 shown as a network pattern structure or any shape.

More particularly, as shown in FIG. 1, the amplifier assembly 1 includes a plurality of alignment concave grooves 13 disposed on the first outer casing 10, and each detachable sound guiding assembly 2 includes a plurality of alignment convex ribs 24 disposed on the second outer casing 20 and respectively corresponding to the alignment concave grooves 13. For example, as shown in FIG. 1, the first retaining structure 11 may be a retaining sliding groove, and the second retaining structure 22 may be a retaining convex body mated with the retaining sliding groove.

Please note, the above-mentioned design for the first retaining structure 11 and the second retaining structure 22 is merely an example and is not meant to limit the instant disclosure. For example, the first retaining structure 11 and the second retaining structure 22 as shown in FIG. 1 can be exchanged according to different requirements. In other words, in another embodiment, the amplifier assembly 1 includes a plurality of alignment convex ribs 24 disposed on the first outer casing 10, and each detachable sound guiding assembly 2 includes a plurality of alignment concave grooves 13 disposed on the second outer casing 20 and respectively corresponding to the alignment convex ribs 24. For yet another example, the first retaining structure 11 further can be replaced by a retaining convex body, and the second retaining structure 22 further can be replaced by a retaining sliding groove that can be mated with the retaining convex body.

Therefore, when one of the detachable sound guiding assemblies 2 is received inside the assembly concave groove 102 of the amplifier assembly 1 according to different requirements, the second outer casing 20 of the detachable sound guiding assembly 2 is detachably positioned inside the assembly concave groove 102 of the amplifier assembly 1 by respectively matching the second retaining structures 22 and the first retaining structures 11 with each other, and the second conductive matching structure 23 electrically contacts the first conductive matching structure 12. For example, the first conductive matching structure 12 and the second conductive matching structure 23 may be any type of conductive matching pins, but that is merely an example and is not meant to limit the instant disclosure.

Please note, the detachable audio broadcasting module M of the instant disclosure can use only one detachable sound guiding assembly 2 to match with the amplifier assembly 1 in different embodiment.

Figure 4:
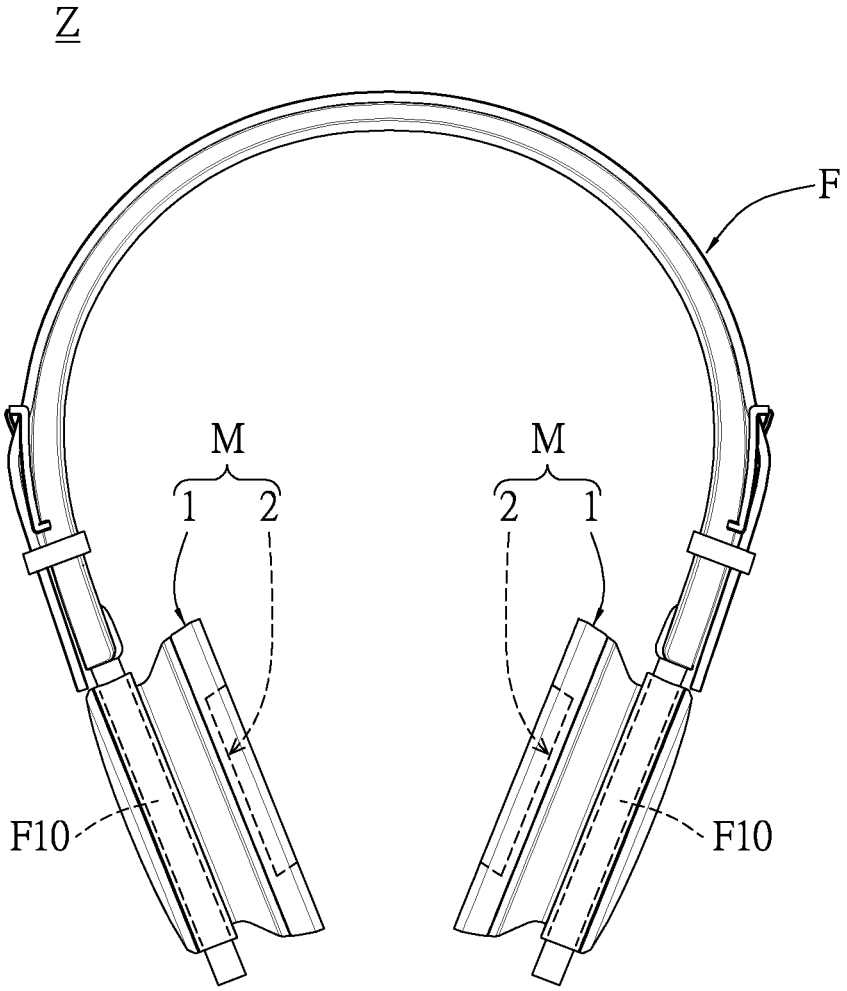
FIG. 4 shows a lateral, schematic view of the customization earphone structure according to the instant disclosure.

Furthermore, referring to FIG. 2 and FIG. 4, the instant disclosure further provides a customization earphone structure Z (e.g., a head mounted earphone or a headphone), comprising: an earphone frame F and two detachable audio broadcasting modules M. In addition, the two detachable audio broadcasting modules M are respectively disposed on two opposite end portions F10 of the earphone frame F, and each detachable audio broadcasting module M includes an amplifier assembly 1 and a detachable sound guiding assembly 2 (or more detachable sound guiding assemblies 2). In other words, the detachable audio broadcasting module M can be used singly or applied to the earphone frame F to form a customization earphone structure Z.

Figure 5:
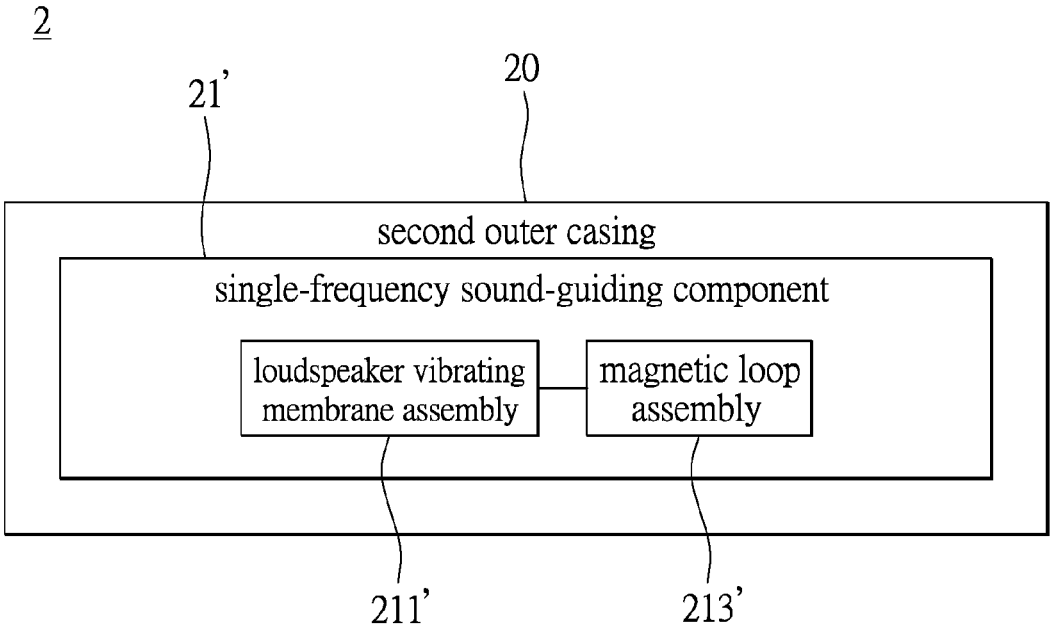
FIG. 5 shows a function block of the detachable sound guiding assembly of the detachable audio broadcasting module using a single-frequency sound-guiding component according to the instant disclosure.

Please note, referring to FIG. 3 and FIG. 5, the coaxial dual-frequency sound-guiding component 21 in FIG. 3 can be replaced by a single-frequency sound-guiding component 21' in FIG. 5 according to different designing requirements. The single-frequency sound-guiding component 21' includes a loudspeaker vibrating membrane assembly 211' and a magnetic loop assembly 213' adjacent to the loudspeaker vibrating membrane assembly 211' and provided for the loudspeaker vibrating membrane assembly 211' to use it. In other words, the detachable sound guiding assembly 2 includes a sound-guiding component, and the sound-guiding component may be a single-frequency sound-guiding component 21' including a loudspeaker vibrating membrane assembly 211' and a magnetic loop assembly 213' or a coaxial dual-frequency sound-guiding component 21 including a woofer vibrating membrane assembly 211, a tweeter vibrating membrane assembly 212, and a common magnetic loop assembly 213, according to different requirements.

In conclusion, because the designs of "the amplifier assembly 1 includes a first outer casing 10, a plurality of first retaining structures 11 disposed on the first outer casing 10, and a first conductive matching structure 12 disposed on the first outer casing 10" and "the detachable sound guiding assembly 2 includes a second outer casing 20 corresponding to the assembly concave groove 102, a coaxial dual-frequency sound-guiding component 21 fixed and enclosed inside the second outer casing 20, a plurality of second retaining structures 22 disposed on the second outer casing 20 and respectively corresponding the first retaining structures 11, and a second conductive matching structure 23 disposed on an outer surface 200 of the second outer casing 20 and corresponding to the first conductive matching structure 12", when one of the detachable sound guiding assemblies 2 is received inside the assembly concave groove 102 of the amplifier assembly 1 according to different requirements, the second outer casing 20 of the detachable sound guiding assembly 2 is detachably positioned inside the assembly concave groove 102 of the amplifier assembly 1 by respectively matching the second retaining structures 22 and the first retaining structures 11 with each other, and the second conductive matching structure 23 electrically contacts the first conductive matching structure 12. Therefore, by using the detachable sound guiding assembly 2, the customization earphone structure Z and the detachable audio broadcasting module M thereof disclosed by the present invention may change or adjust the quality of the sound output according to different application requirements, thereby achieving the need of customization.

The aforementioned descriptions merely represent the preferred embodiments of the instant disclosure, without any intention to limit the scope of the instant disclosure which is fully described only within the following claims. Various equivalent changes, alterations or modifications based on the claims of the instant disclosure are all, consequently, viewed as being embraced by the scope of the instant disclosure.

What is claimed is:

1. A detachable audio broadcasting module, comprising:

an amplifier assembly including a first outer casing, a plurality of first retaining structures disposed on the first outer casing, and a first conductive matching structure disposed on an inner surface of the first outer casing, wherein the first outer casing has an amplifier chamber with a predetermined space formed therein, and the first outer casing has an assembly concave groove communicated with the amplifier chamber; and a plurality of detachable sound guiding assemblies each including a second outer casing corresponding to the assembly concave groove, a coaxial dual-frequency sound-guiding component fixed and enclosed inside the second outer casing, a plurality of second retaining structures disposed on the second outer casing and respectively corresponding the first retaining structures, and a second conductive matching structure disposed on an outer surface of the second outer casing and corresponding to the first conductive matching structure, wherein the coaxial dual-frequency sound-guiding component includes a woofer vibrating membrane assembly, a tweeter vibrating membrane assembly, and a common magnetic loop assembly disposed between the woofer vibrating membrane assembly and the tweeter vibrating membrane assembly and provided for the woofer vibrating membrane assembly and the tweeter vibrating membrane assembly, and the second outer casing has a sound output opening;

wherein one of the detachable sound guiding assemblies is received inside the assembly concave groove of the amplifier assembly, the second outer casing of the detachable sound guiding assembly is detachably positioned inside the assembly concave groove of the amplifier assembly by respectively matching the second retaining structures and the first retaining structures with each other, and the second conductive matching structure electrically contacts the first conductive matching structure.

2. The detachable audio broadcasting module of claim 1, wherein the amplifier assembly includes a plurality of alignment concave grooves disposed on the first outer casing, and each detachable sound guiding assembly includes a plurality of alignment convex ribs disposed on the second outer casing and respectively corresponding to the alignment concave grooves, wherein the first retaining structure is a retaining sliding groove, and the second retaining structure is a retaining convex body mated with the retaining sliding groove.

3. The detachable audio broadcasting module of claim 1, wherein the amplifier assembly includes a plurality of alignment convex ribs disposed on the first outer casing, and each detachable sound guiding assembly includes a plurality of alignment concave grooves disposed on the second outer casing and respectively corresponding to the alignment convex ribs, wherein the first retaining structure is a retaining convex body, and the second retaining structure is a retaining sliding groove mated with the retaining convex body.

4. A detachable audio broadcasting module, comprising:

an amplifier assembly including a first outer casing and a plurality of first retaining structures disposed on the first outer casing, wherein the first outer casing has an amplifier chamber with a predetermined space formed therein, and the first outer casing has an assembly concave groove communicated with the amplifier chamber; and a detachable sound guiding assembly including a second outer casing corresponding to the assembly concave groove, a sound-guiding component fixed and enclosed inside the second outer casing, and a plurality of second retaining structures disposed on the second outer casing and respectively corresponding the first retaining structures;

wherein the detachable sound guiding assembly is received inside the assembly concave groove of the amplifier assembly, and the second outer casing of the detachable sound guiding assembly is detachably positioned inside the assembly concave groove of the amplifier assembly by respectively matching the second retaining structures and the first retaining structures with each other.

5. The detachable audio broadcasting module of claim 4, wherein the sound-guiding component is a single-frequency sound-guiding component including a loudspeaker vibrating membrane assembly and a magnetic loop assembly adjacent to the loudspeaker vibrating membrane assembly and provided for the loudspeaker vibrating membrane assembly.

6. The detachable audio broadcasting module of claim 4, wherein the sound-guiding component is a coaxial dual-frequency sound-guiding component including a woofer vibrating membrane assembly, a tweeter vibrating membrane assembly, and a common magnetic loop assembly disposed between the woofer vibrating membrane assembly and the tweeter vibrating membrane assembly and provided for the woofer vibrating membrane assembly and the tweeter vibrating membrane assembly, and the second outer casing has a sound output opening.

7. The detachable audio broadcasting module of claim 4, wherein the amplifier assembly includes a plurality of alignment concave grooves disposed on the first outer casing, and the detachable sound guiding assembly includes a plurality of alignment convex ribs disposed on the second outer casing and respectively corresponding to the alignment concave grooves, wherein the first retaining structure is a retaining sliding groove, and the second retaining structure is a retaining convex body mated with the retaining sliding groove.

8. The detachable audio broadcasting module of claim 4, wherein the amplifier assembly includes a plurality of alignment convex ribs disposed on the first outer casing, and the detachable sound guiding assembly includes a plurality of alignment concave grooves disposed on the second outer casing and respectively corresponding to the alignment convex ribs, wherein the first retaining structure is a retaining convex body, and the second retaining structure is a retaining sliding groove mated with the retaining convex body.

9. A customization earphone structure, comprising:

an earphone frame; and two detachable audio broadcasting modules respectively disposed on two opposite end portions of the earphone frame, wherein each detachable audio broadcasting module includes:

an amplifier assembly including a first outer casing, a plurality of first retaining structures disposed on the first outer casing, and a first conductive matching structure disposed on an inner surface of the first outer casing, wherein the first outer casing has an amplifier chamber with a predetermined space formed therein, and the first outer casing has an assembly concave groove communicated with the amplifier chamber; and a detachable sound guiding assembly including a second outer casing corresponding to the assembly concave groove, a coaxial dual-frequency sound-guiding component fixed and enclosed inside the second outer casing, a plurality of second retaining structures disposed on the second outer casing and respectively corresponding the first retaining structures, and a second conductive matching structure disposed on an outer surface of the second outer casing and corresponding to the first conductive matching structure, wherein the coaxial dual-frequency sound-guiding component includes a woofer vibrating membrane assembly, a tweeter vibrating membrane assembly, and a common magnetic loop assembly disposed between the woofer vibrating membrane assembly and the tweeter vibrating membrane assembly and provided for the woofer vibrating membrane assembly and the tweeter vibrating membrane assembly, and the second outer casing has a sound output opening;

wherein the detachable sound guiding assembly is received inside the assembly concave groove of the amplifier assembly, the second outer casing of the detachable sound guiding assembly is detachably positioned inside the assembly concave groove of the amplifier assembly by respectively matching the second retaining structures and the first retaining structures with each other, and the second conductive matching structure electrically contacts the first conductive matching structure.

10. The customization earphone structure of claim 9, wherein the amplifier assembly includes a plurality of alignment concave grooves disposed on the first outer casing, and the detachable sound guiding assembly includes a plurality of alignment convex ribs disposed on the second outer casing and respectively corresponding to the alignment concave grooves, wherein the first retaining structure is a retaining sliding groove, and the second retaining structure is a retaining convex body mated with the retaining sliding groove.

11. The customization earphone structure of claim 9, wherein the amplifier assembly includes a plurality of alignment convex ribs disposed on the first outer casing, and the detachable sound guiding assembly includes a plurality of alignment concave grooves disposed on the second outer casing and respectively corresponding to the alignment convex ribs, wherein the first retaining structure is a retaining convex body, and the second retaining structure is a retaining sliding groove mated with the retaining convex body.

* * * * *